US008751312B2

(12) United States Patent
Charoff et al.

(10) Patent No.: US 8,751,312 B2
(45) Date of Patent: Jun. 10, 2014

(54) MODIFIED AUCTION STYLE GAME AND GAME OF CHANCE DRIVEN BY COLLECTIVE USER DATA, RANDOM CHOICE, AND PARTIAL PAYBACK

(76) Inventors: Andrew Charoff, Sunny Isles Beach, FL (US); Mikhail Rozenshteyn, Sunny Isles Beach, FL (US); Joachim Hertel, Sunny Isles Beach, FL (US); Lyubov Zeldis, Ft. Lauderdale, FL (US)

( * ) Notice: Subject to any disclaimer, the term of this patent is extended or adjusted under 35 U.S.C. 154(b) by 1044 days.

(21) Appl. No.: 12/511,343

(22) Filed: Jul. 29, 2009

(65) Prior Publication Data

US 2011/0028198 A1 Feb. 3, 2011

(51) Int. Cl.
*G06Q 30/00* (2012.01)

(52) U.S. Cl.
USPC ..... 705/14.71; 705/37; 705/5; 705/14.14; 463/17; 463/22; 463/25; 463/42

(58) Field of Classification Search
USPC ..... 705/5, 37, 14.14, 14.71; 463/17, 22, 25, 463/42
See application file for complete search history.

(56) References Cited

U.S. PATENT DOCUMENTS

| | | | | |
|---|---|---|---|---|
| 6,847,936 | B2 | 1/2005 | Fang | |
| 7,169,041 | B2 * | 1/2007 | Tessmer et al. | 463/16 |
| 7,438,640 | B2 | 10/2008 | Amour | |
| 2004/0157663 | A1 * | 8/2004 | Gunnar | 463/42 |
| 2007/0174179 | A1 * | 7/2007 | Avery | 705/37 |
| 2008/0064471 | A1 * | 3/2008 | Bozeman | 463/17 |
| 2009/0037311 | A1 * | 2/2009 | Omar | 705/35 |

* cited by examiner

*Primary Examiner* — David L Lewis
*Assistant Examiner* — Chase Leichliter
(74) *Attorney, Agent, or Firm* — Laurence A. Greenberg; Werner H. Stemer; Ralph E. Locher

(57) ABSTRACT

An auction is effected with two levels of participation. A winning ticket is established and the auction object is awarded to the winning ticket. In addition, certain tickets are selected as payback tickets which receive back either the amount paid for the ticket or at least the mean entry fee, which is the average paid for all tickets. The winning ticket is awarded randomly, but the individual tickets in the "drawing" are weighted according to the entry fee paid for the given ticket. The payback tickets are determined according to another criterion, for example the time of purchase or a match between the actual fee paid for the ticket and the mean entry fee.

6 Claims, 7 Drawing Sheets

{212,212,214,211, 248, 206,200,220,213,231,249,211,227,242,248,216,237,229,208,234,241,239,233,249,224,233,211,225,205,209,205,243,200,221,204,206,237,207,244,205,209,231,211,241,241,217,222,204,204,223,243,249,214,235,231,241,219,236,223,205,205,243,231,215,229,226,245,239,231,209,212,238,220,222,221,235,236,244,237,232,219,230,245,240,221,246,206,200,243,238,215,207,248,218,207,224,248,223,216,242}.

{0.0531764,0.0531764,0.0568454,0.0514315,0.176657,0.0435289,0.0356302,0.0694412,0.0549803,0.100218,0.182646,0.0514315,0.0877024,0.144626,0.176657,0.0607674,0.122417,0.0937517,0.0465329,0.110763,0.139883,0.130859,0.10713,0.182646,0.0793521,0.10713,0.0514315,0.0820433,0.0421004,0.0481116,0.0421004,0.14953,0.0356302,0.0717965,0.0407187,0.0435289,0.122417,0.0450058,0.1546,0.0421004,0.0481116,0.100218,0.0514315,0.139883,0.139883,0.0628287,0.0742315,0.0407187,0.0407187,0.0767492,0.14953,0.182646,0.0568454,0.114519,0.100218,0.139883,0.0671632,0.118402,0.0767492,0.0421004,0.0421004,0.14953,0.100218,0.0587737,0.0937517,0.0848257,0.159842,0.130859,0.100218,0.0481116,0.0531764,0.126567,0.0694412,0.0742315,0.0717965,0.114519,0.118402,0.1546,0.122417,0.103616,0.0671632,0.096931,0.159842,0.135296,0.0717965,0.165261,0.0435289,0.0356302,0.14953,0.126567,0.0587737,0.0450058,0.176657,0.0649598,0.0450058,0.0793521,0.176657,0.0767492,0.0607674,0.144626}

{0.00454333,0.00454333,0.00496571,0.00434581,0.0225047,0.00347978,0.00266517,0.00648336,0.00474983,0.0105714,0.0235275,0.00434581,0.00884954,0.0172369,0.0225047,0.00542735,0.0138022,0.00967222,0.00380329,0.0120792,0.0164876,0.0150852,0.0115541,0.0235275,0.00774484,0.0115541,0.00434581,0.00809683,0.00332849,0.00397615,0.00332849,0.0180203,0.00266517,0.00677803,0.00318378,0.00347978,0.0138022,0.00363794,0.0188393,0.00332849,0.00397615,0.0105714,0.00434581,0.0164876,0.0164876,0.00567402,0.00708609,0.00318378,0.00318378,0.00740814,0.0180203,0.0235275,0.00496571,0.0126282,0.0105714,0.0164876,0.00620151,0.0132021,0.00740814,0.00332849,0.00332849,0.0180203,0.0105714,0.0051914,0.00967222,0.00846483,0.0196955,0.0150852,0.0105714,0.00397615,0.00454333,0.0144294,0.00648336,0.00708609,0.00677803,0.0126282,0.0132021,0.0188393,0.0138022,0.0110518,0.00620151,0.0101118,0.0196955,0.0157708,0.00677803,0.0205906,0.00347978,0.00266517,0.0180203,0.0144294,0.0051914,0.00363794,0.0225047,0.00593191,0.00363794,0.00774484,0.0225047,0.00740814,0.00542735,0.0172369}

{{3,1}, {5, 3}, {7,1}, {8,1}, {10,1}, {11,1}, {12,1}, {14,2}, {15,1}, {17,1}, {21,2}, {23,1}, {24,3}, {25,1}, {26,1}, {27,1}, {28,2}, {30,1}, {31,1}, {32,3}, {33,1}, {34,2}, {36,1}, {42,3}, {43,1}, {44,2}, {45,2}, {46,1}, {47,1}, {51,3}, {52,5}, {53,1}, {54,1}, {58,1}, {59,1}, {62,2}, {63,2}, {65,1}, {67,2}, {68,2}, {71,1}, {72,1}, {73,1}, {74,1}, {75,1}, {76,1}, {77,1}, {80,3}, {82,2}, {83,1}, {84,1}, {85,1}, {86,3}, {89,1}, {91,1}, {93,4}, {94,2}, {95,2}, {96,2}, {97,3}, {98,1}, {100,2}}

{5,11,14,16,17,36,38,41,41,45,48,49,51,66,70,87,100,105,114,120,120,121,140,153,164,167,169,173,185,205,211,225,226,237,242,255,263,268,271,272,286,288,297,298,301,309,314,324,335,340,344,346,364,366,368,382,396,400,403,411,420,433,435,445,454,465,470,479,492,493,496,502,511,519,530,536,545,545,547,558,558,567,567,583,597,598,601,602,602,627,630,631,632,660,667,669,671,692,714,715}

{0,0,1,0,0,1,0,1,2,0,0,0,0,0,0,0,0,0,1,1,2,0,1,0,2,1,0,0,0,0,0,0,1,0,1,0,0,0,0,0,0,1,0,0,0,0,0,1,0,1,
0,0,0,0,1,0,0,3,0,0,0,0,0,0,0,0,0,1,0,0,0,0,0,1,0,0,0,0,0,1,1,1,0,1,0,0,0,0,0,1,0,0,0,0,0,0,0,0,1,0,0,1,0,
0,0,0,0,0,1,1,0,0,0,0,1,0,0,1,0,0,0,0,0,1,0,0,0,1,0,0,1,1,1,0,0,0,0,0,0,1,1,0,0,0,1,1,1,0,0,0,1,0,0,1,0,0,0,
0,1,0,0,0,0,1,0,0,1,0,1,1,0,0,0,0,0,0,0,0,1,1,1,0,0,0,0,0,0,1,0,0,0,0,0,0,1,0,1,1,0,0,0,1,0,0,0,0,1,0,0,0,0,
0,1,1,0,0,0,0,1,0,0,0,0,1,0,0,0,0,1,0,0,1,0,0,0,1,0,0,0,0,0,0,2,0,1,0,0,1,0,0,0,1,0,0,0,1,0,0,0,0,0,1,0,0,1,
0,0,0,2,1,0,0,0,0,0,2,0,0,0,2,0,0,0,0,0,0,0,1,0,0,0,0,0,0,1,1,1,2,0,0,0,0,0,0,0,0,0,0,0,1,0,2,1,0,0,0,0,0,0,
0,0,0,0,0,0,0,1,0,0,1,1,1,0,0,0,0,0,0,0,0,0,0,1,0,0,0,0,0,0,0,0,0,0,0,2,0}

FIG. 11A

{0,1,1,1,2,0,0,0,0,2,2,1,3,0,0,0,1,1,0,0,0,1,0,0,0,1,1,0,1,0,3,0,0,0,0,1,0,0,1,0,0,2,1,1,0,0,1,0,0,0,0,1,1,
0,0,0,2,0,0,1,1,0,0,1,0,1,0,2,1,0,0,1,1,0,2,1,0,1,1,0,0,1,0,1,0,1,2,0,0,0,0,2,1,0,0,1,0,0,0,1,2,0,1,0,0,1,0,
0,2,0,0,1,0,1,0,0,1,1,0,1,0,0,0,2,1,1,0,1,0,1,0,0,1,0,1,0,3,0,0,2,0,2,0,0,0,1,0,0,0,2,3,0,0,0,0,0,1,2,1,0,0,
0,0,0,0,1,1,2,0,0,0,0,0,1,0,0,0,0,2}

FIG. 11B

{1,4,0,2,5,1,1,1,1,0,2,1,3,0,1,1,3,1,1,0,1,1,2,1,1,1,2,2,2,2,2,1,1,1,3,0,3,0,1,1,2,1,1,2,1,1,1,2,0,3,1,2,0,
2,3,2,2,0,1,2,3,0,1,3,0,0,3,1,0,1,0}

FIG. 11C

{3,2,4,4,2,1,1,2,3,1,2,3,1,1,1,3,1,3,2,4,3,1,3,1,3,1,3,1,2,2,1,3,2,2,2,2,3,4,1,2,3,1,3,0,4,0,1}

FIG. 11D

FIG. 12

| Bin Length | Mean of BC (mv) | Variance of BC (var) | Standard Deviation of BC (sd) | Status |
|---|---|---|---|---|
| 1 | 0.139082 | 0.136618 | 0.369619 | accepted |
| 2 | 0.278552 | .274148 | 0.523591 | accepted |
| 3 | 0.41841 | 0.446046 | 0.667867 | rejected |
| 4 | 0.558659 | 0.585023 | 0.764868 | rejected |

FIG. 13

BCM={0,0,0,0,0,1,0,0,0,0,0,1,0,0,1,0,1,1,0,0,0,0,0,0,0,0,0,0,0,0,0,0,0,0,0,0,1,0,1,0,0,2,0,0,0,1,0,0,1,1,0,1,0,0,0,
0,0,0,0,0,0,0,0,0,0,0,1,0,0,0,1,0,0,0,0,0,0,0,0,0,0,0,0,0,0,1,0,0,0,0,0,0,0,0,0,0,0,1,0,0,0,0,1,0,0,0,0,0,0,0,
1,0,0,0,0,0,2,1,0,0,0,0,0,0,0,0,0,0,0,0,0,0,0,0,0,1,0,0,0,0,0,0,0,0,0,0,0,1,0,0,0,0,0,0,0,0,0,1,0,0,1,0,1,0,0,0,
1,0,0,0,0,0,0,0,0,0,0,1,0,0,0,0,0,0,0,0,0,0,0,0,0,0,0,0,0,0,1,0,0,0,0,0,1,0,0,0,0,0,0,0,0,0,0,0,1,1,0,0,0,0,0,
0,0,0,0,0,1,0,0,0,0,1,0,0,0,0,0,0,0,0,0,0,0,0,1,0,0,0,0,0,0,0,1,0,0,0,0,1,0,0,1,1,0,0,0,0,0,0,0,0,0,0,0,0,1,0,1,0,0,
0,0,0,0,0,0,1,1,0,0,1,0,0,0,0,0,0,0,1,0,0,0,0,1,0,0,0,0,0,0,0,0,0,1,0,0,0,0,0,0,0,0,0,1,0,0,0,1,0,0,0,1,0,1,0,0,0,
0,0,0,0,0,0,0,0,0,0,0,0,0,1,0,1,0,1,0,0,0,0,0,0,0,0,0,0,0,0,1,0,0,0,0,0,0,0,0,0,0,0,1,0,0,0,1,0,0,1,0,1,0,0,0,0,0,
0,0,1,0,0,0,0,0,0,0,0,1,0,0,0,0,0,0,0,0,0,0,0,0,1,0,1,0,0,0,0,0,0,0,0,0,1,0,0,0,0,0,0,0,0,1,0,0,0,0,0,0,0,0,1,0,0,
0,0,1,0,0,0,0,0,0,0,0,1,0,0,0,0,0,0,0,0,0,0,0,0,1,1,0,0,1,0,0,0,0,0,1,0,0,0,0,0,0,0,0,1,0,0,0,0,0,0,1,0,0,0,0,0,0,
0,0,0,1,0,0,0,0,0,1,0,0,0,0,0,0,0,2,0,1,0,0,0,0,0,0,0,0,0,0,2,0,0,0,0,0,0,0,0,2,0,0,0,0,0,0,0,0,0,0,0,0,0,0,1,0,0,
0,0,0,0,0,0,0,0,0,0,1,1,0,0,1,2,0,0,0,0,0,0,0,0,0,0,0,0,0,0,0,0,0,0,0,0,0,0,1,0,0,1,1,1,0,0,0,0,0,0,0,0,0,0,0,0,0,
0,0,0,0,0,0,0,0,0,0,0,0,0,0,1,0,0,0,0,0,1,0,1,0,1,0,0,0,0,0,0,0,0,0,0,0,0,0,0,0,0,0,0,0,0,1,0,0,0,0,0,0,0,0,0,0,0,
0,0,0,0,0,0,0,0,0,0,1,1,0,0,0}};

Poisson generated sample:

{0,0,0,0,0,0,0,0,0,0,1,0,0,0,0,0,0,0,0,0,0,0,0,0,0,1,0,2,0,0,0,0,0,0,1,0,0,0,0,0,0,0,0,0,0,0,0,0,0,0,0,0,0,0,0,0,0
,0,0,0,0,0,0,0,1,0,0,0,1,0,1,0,0,0,0,0,0,0,0,0,0,0,0,0,0,0,1,0,0,0,0,1,0,0,0,0,2,0,1,0,1,0,0,0,0,0,0,0,0,0,0,0,0,
1,0,0,0,0,0,0,0,0,0,0,1,0,0,0,0,0,0,1,0,0,0,0,0,0,0,1,0,1,0,0,0,0,0,0,0,0,0,0,1,0,0,0,0,0,1,0,0,0,0,0,0,0,0,1,1,
0,0,0,0,0,0,0,0,1,0,1,0,0,0,0,0,0,1,0,1,0,0,0,0,1,0,0,1,0,0,0,0,0,0,1,0,0,0,0,0,0,1,0,0,0,0,0,1,0,0,0,0,1,0,0,0,0,
0,1,1,0,1,0,0,0,0,0,0,0,0,1,0,0,0,1,0,0,1,0,0,0,0,0,0,1,0,0,0,0,0,1,1,0,0,0,0,0,0,0,0,0,0,0,2,0,0,0,1,0,0,0,0,0,0,
0,0,0,0,1,0,0,0,0,0,0,0,0,0,0,0,0,0,0,0,0,0,0,0,0,0,0,0,0,0,0,1,0,0,0,1,0,0,0,1,0,0,0,0,0,0,0,0,0,0,0,0,0,0,0,0,0,
1,0,0,0,0,0,0,1,0,0,0,0,0,0,0,1,0,0,0,0,0,1,0,1,0,0,0,0,0,0,0,0,0,0,0,0,0,0,0,0,0,0,0,0,0,0,0,0,0,0,0,0,0,0,0,0,0,
0,0,0,0,0,0,0,1,0,0,0,0,0,0,0,0,1,1,0,0,0,0,0,0,0,1,0,0,0,0,0,0,0,0,0,0,0,0,0,0,0,0,1,0,0,0,0,0,0,0,0,0,0,0,1,0,0,
1,0,0,0,0,0,0,0,1,0,0,1,0,0,0,0,0,0,0,0,1,0,1,0,0,0,0,0,0,0,0,0,0,0,0,0,0,1,0,0,1,0,0,0,0,0,0,0,0,0,0,0,0,0,2,0,
0,0,0,0,0,0,0,1,0,0,0,0,0,0,0,0,0,0,1,0,0,0,0,0,0,0,0,0,0,0,0,0,0,0,0,0,0,1,1,0,0,0,0,0,0,0,0,0,0,0,0,0,1,0,0,
0,0,1,0,0,0,0,0,1,0,0,0,0,1,0,0,1,0,0,0,0,0,0,0,1,0,0,0,0,1,0,0,0,0,0,0,0,0,1,0,0,0,0,0,1,1,0,0,0,0,0,0,0,0,0,0,0,
0,1,0,0,0,0,1,0,0,1,0,0,0,0,0,0,0,1,0,0,0,0,0,1,0,0,0,0,1,0,0,0,0,0,0,1,0,0,0,0,1,0,0,0,0,0,0,0,0,0,0,0,0,1,0,0,0,
0,0,0,0,0,0,0,0,0,1,0}.

MODIFIED AUCTION STYLE GAME AND GAME OF CHANCE DRIVEN BY COLLECTIVE USER DATA, RANDOM CHOICE, AND PARTIAL PAYBACK

FIELD OF THE INVENTION

The invention relates to a method of performing an auction and, more specifically, a live auction in which one or more objects are presented for purchase and the auction winner receives the object or objects for a "purchase" price which is considerably lower than the actual value thereof.

BACKGROUND OF INVENTION

Auction-style games and games of chance may be defined as a game where the player pays for the opportunity to win a prize, and whether or not the player wins the prize is determined solely by chance, with no skill involved on the part of the player. Such games are of course very popular and widely practiced or played.

Those games must have a sufficient appeal to entice customers to purchase and play the game in numbers great enough to generate significant revenues. Therefore, new games are continually being introduced in the hope that they will be popular, while older or less popular games are retired or revamped. In addition, players know that even with tickets that provide multiple chances to win, the majority of the time they are not going to win anything, which discourages the casual player.

It would be desirable to describe a new type of modified game of chance where the pure random choice function is replaced by an algorithmic combination of collective user data and traditional random choice coupled with an additional payback function. Such novel elements would likely provide a more interesting game and enhance and support player interest and excitement and tend to increase players' chance of winning.

Numerous gaming activities are known and have been implemented in a variety of different forms. By way of example, one broad category of gaming activity is commonly referred to as pari-mutuel gaming. In this form, it is typical for the entry fees provided by players in relation to a gaming activity to be combined into a pool, the operator's commissions, fees and charges deducted from the pool, and for the residual amount to define a prize pool for distribution among the winners of the gaming activity, according to predetermined criteria. Lotteries and the like fall into this category.

U.S. Pat. No. 7,438,640 B2 (and patents referenced therein) describes such gaming that is modified by introducing a wide variety of risk profiles wherein each risk profile defines a proportion of an entry fee that is refundable on the basis of predetermined refund criteria and a complementary proportion of the entry fee that is placed at risk.

BRIEF SUMMARY OF THE INVENTION

It is accordingly an object of the invention to provide a novel auction or a game of chance which overcomes the above-mentioned disadvantages of the heretofore-known devices and methods of this general type and which enhances the desirability to participate in the game and thus to contribute to the winning pool and which provides for an improved auction configuration with a modified contribution pool and modified prize distribution.

With the foregoing and other objects in view there is provided, in accordance with the invention, an auction method, which comprises:

providing an object for auction;

opening the auction by offering auction tickets for sale and, upon selling the tickets, assigning to each ticket a unique identifier associating the respective ticket with an auction participant, a time stamp representing a time of purchase, and a value stamp representing an amount paid for the ticket;

closing the auction, counting a total number of tickets purchased to define a total number of participants (N) and summing all amounts paid for the tickets to determine a total entry fee received;

freely selecting an admissible weight function fulfilling the following characteristic behavior:

the relative weight remains 1 if your entry fee is not significantly different from the rest of the entry fees.

the relative weight tends to 0 if your entry fee is significantly lower than the rest of the entry fees.

the relative weight grows beyond 1 if your entry fee is significantly higher than the rest of the entry fees.

and determining a winner of the object for auction from one of the tickets sold by making a weighted random selection based on the weights computed according to the admissible weight function from the pool of all sold tickets and allowing the one auction participant to take possession of the auction object.

In accordance with an added feature of the invention, one or more tickets are defined as payback tickets, which receive back a value at least equal to the mean entry fee, and each auction participant associated with a payback ticket is paid the value at least equal to the mean entry fee.

In accordance with an additional feature of the invention, the one or more payback tickets are selected in accordance with a statistical procedure based on bin counting the purchasing times ("Arrival Times") and comparing the best fit bin count to Poisson distribution generated samples of the same mean value. In an advantageous embodiment of the invention, the payback tickets are established by picking out of the number of participants N that best fit the expected arrival times The first element of the novel system deals with the winner of the auction, or the winning ticket. In contrast with the prior art, we tie the individual amount spent by a given participant to all amounts paid by the other participants. We utilize a weight function to illustrate the concept. No one knows at the outset what the chances are to draw or purchase the winning ticket. The average amount of money that one has to spend to win the ticket cannot be known during the purchasing time period. It can be known only after the game is closed and all monies are collected.

The current invention overcomes the need for risk profiles and replaces them by an algorithmic coupling of data associated to all players in the game and traditional random choice elements. This algorithmic coupling allows gaming situations that are not possible with risk profiles as introduced in the prior art. The main reason is that risk profiles as defined in the prior art are mainly based on either static criteria or dynamic criteria associated with linear functions of the type $E_{player}=k*A+B$ where A, B and k are certain factors related to the players' activity.

The current invention introduces an unlimited variety of nonlinear weight functions that provide for much great flexibility and can describe situations mathematically not possible by using linear functions.

It is a second novel aspect of the current invention to introduce Poisson distribution related statistics to award payback tickets to players, an element that is completely missing in the prior art.

Finally, we change one of the characteristic features of prior art gaming. In a typical implementation, the players do not know the winning amount upfront. The current invention defines a unique winning prize for the game and on top enables every ticket holder to receive one of possibly many payback prizes. Given these novel elements we are now referring to a modified auction-style of game and a modified game of chance.

In the most generalized summary, the invention relates to a method of play of an auction-style game and a game of chance wherein there is exactly one winning ticket per game, there are multiple payback tickets per game and wherein the component of chance is replaced by a novel algorithmic relation between collective data of all participating players combined with traditional random choice.

It is accordingly an object of the invention to provide a modified auction-style game and a simple game of chance with the component of pure chance to select winning tickets replaced by a component of algorithmic coupling of collective user data, random choice and payback function.

With the foregoing and other objects in view there is provided, in accordance with the invention a modified auction-style game/game of chance $\mathcal{G}$ that is defined in this invention as an object $$\mathcal{G} := \langle N, p_1, \ldots, p_N, WT, PBT_1, \ldots, PBT_n, T_i, T_f, t_1, \ldots, t_N, \omega, s \rangle$$

where:

N: the total number of tickets in the game pi: the entry fee for the $i^{th}$ ticket, i=1, . . . , N WT: the monetary value of the winning ticket PBTi: monetary value of the $i^{th}$ payback ticket, I=1 . . . n Ti: timestamp game starts Tf: timestamp game ends ti: timestamp of purchase of the $i^{th}$ entry ticket ω: weight function used to award the winning ticket s: statistical threshold (in %) used to award payback tickets.

In this context, the profit $\mathcal{P}$ of a game $\mathcal{G}$ is defined as $$P(G) : \stackrel{def}{=} \sum_{j=1}^{N} p_j - WT - \sum_{j=1}^{n} PBT_j$$

This game may be operated as a loss leader for whatever reason, such as for advertising or other public relations purposes. In that case, of course, there will be added a further element in this profitability calculation.

The game $\mathcal{G}$ comprises two novel elements. The first element is to select a weight function w to enable a weighted random decision to award the winning ticket. Second, the recording, selection and statistical treatment of all purchasing timestamps are used to filter out those tickets that had been purchased "right on time" relative to a Poisson distribution and award them the payback tickets.

In accordance with the first novel feature of the invention, the game $\mathcal{G}$ contains an algorithmic coupling of user data and random choice in selecting the winning ticket. The algorithmic coupling comprises the following procedure.

In a first step, we use the weight function w to attach an absolute weight $w_i$ to each entry fee $p_i$ $$w_i \stackrel{def}{=} \omega(i, p_1, \ldots, p_N)$$

The actual weight function ω can be freely chosen to be any function fulfilling the following qualitative characteristics:

The relative weight remains 1 if your entry fee is not significantly different from the rest of the entry fees.

The relative weight tends to 0 if your entry fee is significantly lower than the rest of the entry fees.

The relative weight grows beyond 1 if your entry fee is significantly higher than the rest of the entry fees.

Weight functions with these properties are called admissible weight functions.

In a second step, we compute relative weights $\overline{w_i}$ by averaging over all absolute weights $w_i$:

$$\overline{w_i} \stackrel{def}{=} w_i \Big/ \sum_{j=1}^{N} w_j$$

In a third step, these relative weights $\overline{w_i}$ now serve to perform a weighted random choice on the ticket numbers 1 . . . N. The winning index determined by:

$$\text{Winning Ticket Index} = \text{WeightedRandomChoice}[\{\overline{w_1}, \ldots, \overline{w_N}\} \rightarrow \{1, \ldots N\}],$$

where the weighted random choice gives a random choice weighted by the relative weight $\overline{w_i}$ for the index i.

The classical random choice auction game or a simple game of chance attaches a 1/N chance to the winning ticket. The weighted random choice algorithm uses any admissible weight function ω from an unlimited pool of potential weight functions and attaches a relative weight $\overline{w_i}$ to the $i^{th}$ ticket. The relative weights increase or decrease the winning chance of a ticket. Once the relative weights are computed, the weighted random choice is performed.

Although the exact weight function ω is not disclosed to the players, it enhances interest in the game, because they implement the principle that you can increase your winning chance by paying more relative to all other players. Thus, even if the weight function is known to all players, it is not enough knowledge to pre-determine who wins the winning ticket. The complete knowledge to make such decision becomes available only after closing the game and even then there remains an element of random choice. This coupling of user data with pure chance by using the method of weighted random choice is generating interest in the game, because it engages the player on an additional level of betting while still keeping a certain amount of "gaming luck" intact by performing a weighted random choice to select the winning ticket.

The second novel element of the auction-style game deals with the question as to who will win the payback tickets. In the exemplary embodiment described here, every player in the game, including the winning ticket holder, is eligible for a payback ticket. It will be understood, of course, that the winning ticket may be excluded from payback eligibility.

The algorithmic coupling between user data and chance for selecting payback tickets is based on the idea that the timestamps for buying tickets ("arrival times") can be modeled as a Poisson distribution. As our game duration is finite and we are not dealing with huge number of tickets per game, these assumptions cannot be true in a strict mathematical sense. However, the novelty of the algorithmic coupling takes these restrictions into account. We do this by dealing with bin-counts of arrival times and computing statistical values, such as mean, variance and standard deviation for the bin count population. Based on these data we are then able to select an optimal bin length, which serves as an input to award the payback tickets.

Other features which are considered as characteristic for the invention are set forth in the appended claims.

Although the invention is illustrated and described herein as embodied in a modified auction system with auction/game of chance components, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawing.

BRIEF DESCRIPTION OF THE DRAWING

FIGS. 11A-11D show bin counts for the interval lengths 2 minutes, 4, minutes, 10 minutes, and 15 minutes, respectively.

FIG. 12 displays a table showing bin length, mean value, variance, standard deviation, threshold result and final assessment (accepted/rejected) for bin lengths 1 to 4.

FIG. 13 shows the master bin sample and one Poisson generated sample. The first two identically loaded bins are emphasized.

DESCRIPTION OF A PREFERRED EMBODIMENT OF THE INVENTION

The novel system according to the invention may be implemented in a plurality of environments. For example, the subject of the auction may be a small-value item such as those that are typically processed in a raffle drawing. It is also possible, however, to auction off luxury items or real estate, for example. The entry fee collection and the ticket distribution may be effected in a manual system. However, the system will typically be organized in a computer-processed environment. In either case, the following description may make it entirely clear that the selection of the winning ticket and, maybe more so, the selection of the payback ticket(s) is virtually impossible to process without the aid of one or more computers.

Figure 1:
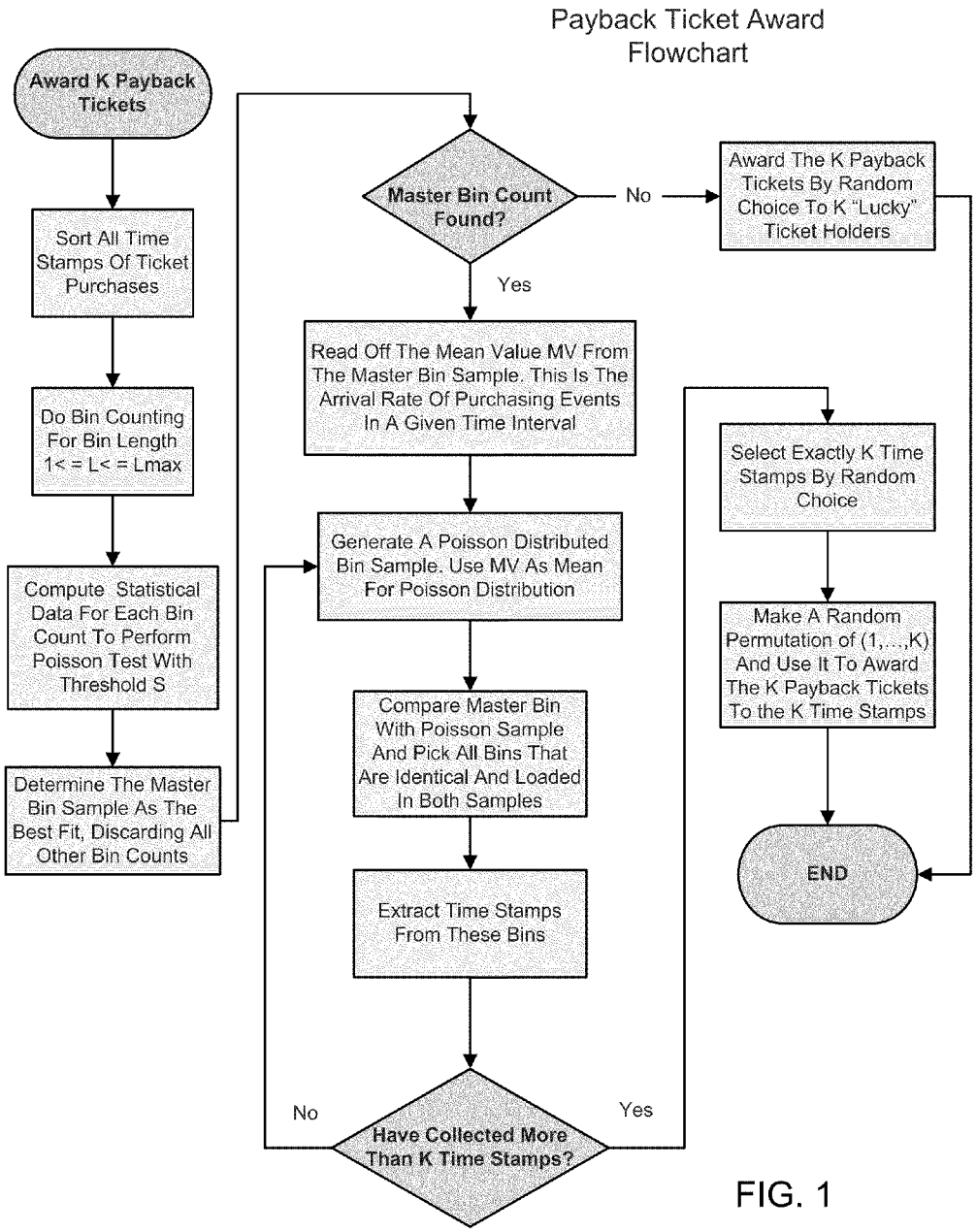
FIG. 1 shows a detailed flowchart of an exemplary embodiment of the procedure according to the invention for awarding payback tickets.

Referring now to the figures of the drawing in detail and first, particularly, to FIG. 1 thereof, the exemplary algorithm comprises the following steps:

Step 1: After close of game, all arrival times are sorted and organized in an ascending list $$TA:=\{t_1, \ldots, t_N\}$$

There exists a unique one-to-one relationship between the purchasing timestamp and the game ticket. It should also be noted that, if ticket sales are effected from, say, 8 am to 8 pm daily and extended over many days, we are not counting the off-times and adjust the timestamps accordingly.

Step 2: perform a bin-count on set TA with bin length 1, 2, 3 . . . (Time intervals of 1 min, 2 min and so on) A bin-count counts how many arrival times occur in each time interval. Let $BC_i$ denote the bin count result set with bin length l.

Step 3: For each set $BC_1$, $BC_2$ . . . compute the statistical measures Mean Value (mv), Variance (var) and Standard Deviation (sd) as follows $$mv_i=\text{Mean Value}[BC_i]$$

$$var_i=\text{Variance}[BC_i]$$

$$sd_i=\text{StandardDeviation}[BC_i]$$

Step 4: Select all s-admissible $BC_i$ that fulfill the Poisson criterion with threshold s:

$$|mv_i-var_i|<s$$

$$|sd_i-\sqrt{mv_i}|<s$$

A typical value for s is 0.01 (1%). See, FIG. 12, which displays a table showing bin length, mean value, variance, standard deviation, threshold result and final assessment (accepted/rejected) for bin lengths 1 to 4.

Threshold is s=0.01 and the status is "accepted" if the foregoing two relationships are satisfied.

Step 5: From all s-admissible $BC_i$ pick the one that best fulfills the threshold. Call it the master bin sample BCM.

The mean value and variance of BCM determine our average arrival rate mv=$\lambda$ of purchasing events per l minutes.

Next we generate random samples of bin counts that are Poisson distributed with mean $\lambda$. Each Poisson sample is compared to the master bin sample and we pick out those individual bins that are occupied equally in both samples. These bins contain specific time stamps that occurred "right on time" relative to the (assumed) Poisson process. We continue this process until we have picked as many different timestamps as we have payback tickets in the game. In this case, duplicate picks are ignored.

We then make a random permutation (1 . . . n) and award the payback tickets to the selected timestamps.

If none of the sets $BC_1$, $BC_2$, . . . are s-admissible, the payback tickets are awarded randomly.

The arrival time method engages the player. The player can somehow make a bet on "how in tune" his purchasing time might be. If a large group of buyers start to purchase very early or very late or in a coordinated way, the arrival time distribution is probably getting biased which brings the chances to win a payback ticket back to the classical pure random chance. The more the community of players purchase tickets in a statistically independent rate with constant number of purchasing events per time unit, the more likely it is that those players win a payback ticket, that are purchasing "right on time", that is whose arrival time really falls within the most likely time bin. This collective data dependency might engage the individual player, spark additional interest in the game and offers another "betting" chance on the collective time of arrival pattern. It contributes to make the game more interesting and might increase revenue. For an explicit example of this algorithm see the following description of a preferred embodiment.

The novel system according to the invention may be implemented in a plurality of environments. The winning ticket WT can represent small items, or big and luxury items or real estate or virtually anything that generates enough interest to buy gaming tickets. The payback tickets provide an additional incentive to participate. The entry fee collection and the prize ticket distribution might be effected in a manual system. However, the system will typically be organized in a computer-processed environment, centralized or de-centralized, web based or hosted on a local computer. The intricate coupling of user data, statistical treatment and random choice makes a computer based implementation mandatory, as it is virtually impossible to do the required calculations in a reasonable time without the aid of a computer.

We will, in the following description of an exemplary embodiment of the invention describe a family of admissible weight functions and provide an explicit algorithm to compute the index of the winning ticket.

An example of a family of admissible weight functions for the preferred embodiment is defined as follows:

$$\omega_\alpha(x, \overline{p}) := \frac{e^{\frac{\alpha * x}{\overline{p}}} - 1}{e^{\alpha} - 1}$$

With:

$\alpha$: a free parameter >0, that indexes the family and enables easy tuning $\overline{p}$: The average entry fee of a game, that is $$\overline{p} = \frac{\sum_{k=1}^{N} p_k}{N}$$

x: input parameter, in this context typically an entry fee

Figures 2, 3, 4:
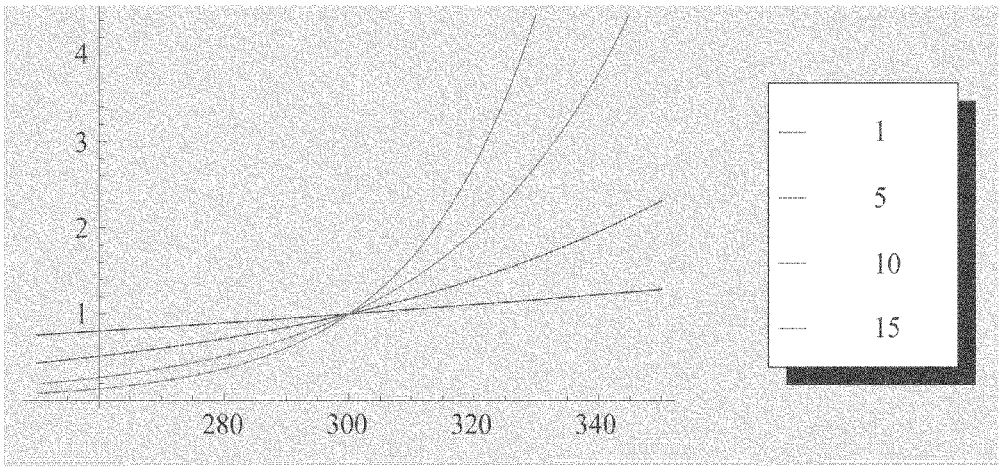
FIG. 2 shows the weight function graph of a specific example of an admissible weight function family, index by a tuning parameter $\alpha$ for values $\alpha$=1, 5, 10, 15 and a sampling of entry fees around an average entry fee of 300.
FIG. 3 displays a list of 100 sample entry fees between \$200 and \$250. The corresponding average entry fee is $\bar{p}$=\$225. Ticket 5 is highlighted.
FIG. 4 displays the list of attached weights, computed with the explicit weight function $\omega_{10}$ using is $\bar{p}$=\$225.

It is readily seen that this family of functions is admissible:

If a player pays entry fee $p=\overline{p}$ we have $\omega_\alpha(p,\overline{p})=1$ for all $\alpha$ If a player pays entry fee $p<<<\overline{p}$ we have $\omega_\alpha(p,\overline{p})\approx 0$ for all $\alpha$ If a player pays entry fee $p>>>\overline{p}$ we have $\omega_\alpha(p,\overline{p})>>>1$ for all $\alpha$ FIG. 2 shows the weight function graph for various tuning parameters a and a sampling of entry fees around an average fee.

We continue to describe the preferred embodiment by referring to the figures and explicit data.

Figures 5, 6:
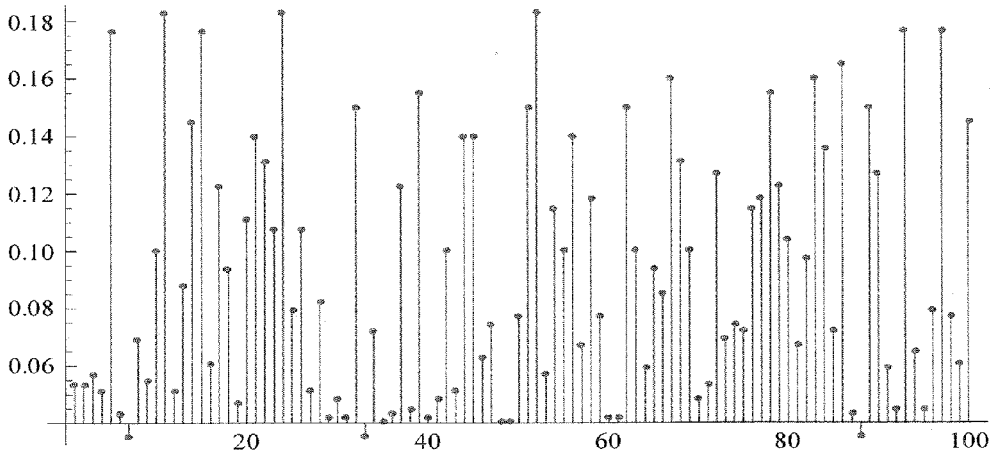
FIG. 5 is a plot of data displayed in FIG. 4.
FIG. 6 shows the computed relative weights $\overline{\omega}_{10}$ for the data displayed in FIG. 4. The relative weight for ticket 5 is highlighted.

We pick $\alpha=10$, N=100. We assume that the 100 entry fees for the tickets are randomly distributed between \$200 and \$250. FIG. 3 displays a list of 100 sample entry fees. The corresponding average entry fee is $\overline{p}$=\$225. FIG. 4 displays the list of attached weights, computed with the explicit weight function $\omega_{10}$ using $\overline{p}$=\$225. FIG. 5 is a graphical plot of these data. FIG. 6 shows the computed relative weights $\overline{\omega}_{10}$ and FIG. 7 is a graphical plot of these data.

The actual selection of the winning ticket is done by a weighted random choice. For example, entry ticket 5 paid \$248, which is more than the average. The attached relative weight is $$\overline{\omega}(p_5,\overline{p})_{10}=0.0225047$$

That is, entry ticket 5 has a weighted chance of roughly 2% to win, which is above the statistical pure random chance of 1% for this scenario as we have 100 entry tickets.

Figures 7, 8:
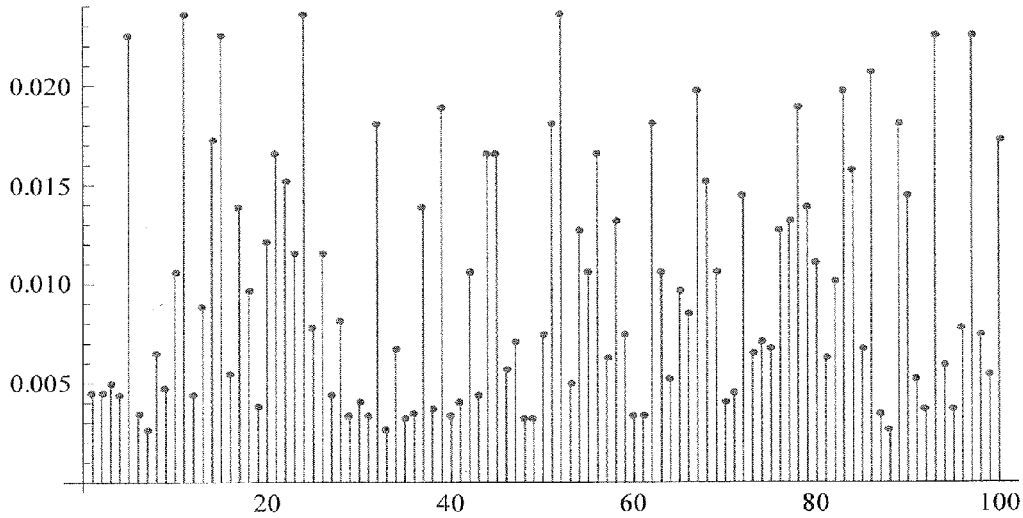
FIG. 7 is a plot of data in FIG. 6.
FIG. 8 displays the tally of 100 sample drawings for the winning ticket. In this data, we see e.g. that ticket 5 was awarded the winning ticket 3 times (highlighted entry (5, 3)).
Figures 9, 10:
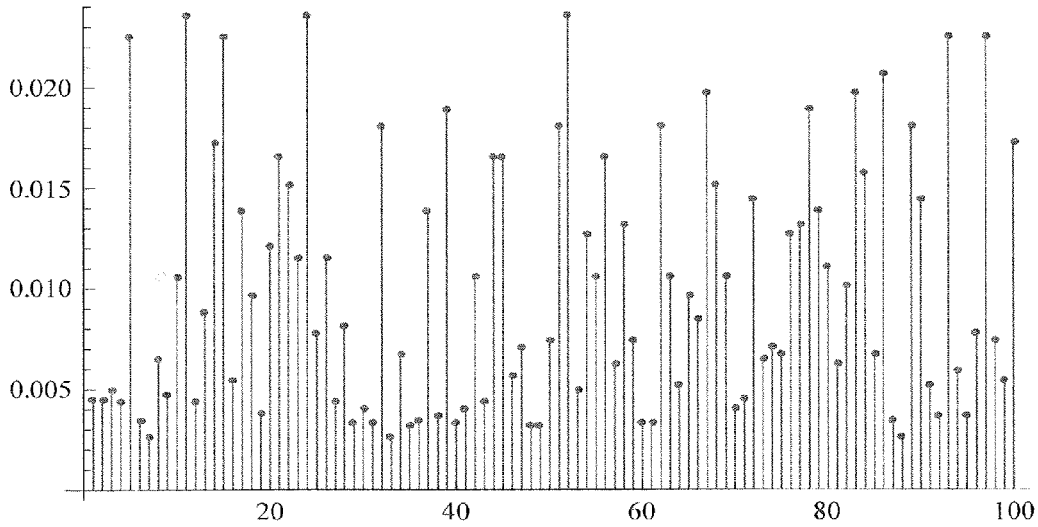
FIG. 9 is a plot of the data in FIG. 8.
FIG. 10 displays a sample of 100 timestamps, represented as integers between 0 and 719. In our example a timestamp 0 means the ticket was purchased sometime between 8:00 am and 8:01 am. A timestamp of 719 means, the ticket was purchased in the last minute of the game, namely sometime between 7:59 pm and 8:00 pm. See the highlighted timestamps.

In FIG. 8 we display the numeric count of 100 sample drawings for the winning ticket. In this data, we see e.g. that ticket 5 won 3 times (5, 3). FIG. 9 is a plot of these results.

We continue with the preferred embodiment by describing the algorithm for selecting the payback tickets in this specific setup. For argument sake we assume to have two payback tickets PBT1 and PBT2 and a game duration from 8 am to 8 pm on any given day. We further assume that the 100 tickets were purchased somehow randomly distributed during the 12 hour=720 min duration of the game. We represent the time stamps as simple integers. Time stamp 5 means, the ticket was purchased during the $5^{th}$ minute of the game that is sometimes between 8:05 am and 8:06 am. Accordingly a time stamp 523 means the ticket was purchased sometime between 4:43 pm and 4:44 pm. FIG. 10 displays a sample of 100 timestamps, represented as integers between 0 and 719.

We further assume that the threshold s for statistical analysis is set to s=0.01 (1%).

Next step is to perform and filter out the master bin count. In the preferred embodiment a bin count of length I is a time interval of 1 minutes. A bin-count is a count of how many ticket timestamps are in the first 1 minutes, the second 1 minutes and so on. FIG. 11 displays the bin-count for length 2, 4, 10 and 15 in FIGS. 11A, 11B, 11C, and 11D, respectively.

FIG. 11A relates to a Bin Count for interval length 2 min. The first 0 (emphasized) means there was no ticket purchase in the first 2 minutes. The bin count 2 at position 9 (emphasized) means there were two ticket purchases in the ninth 2-minute interval, that is in the time slot from 8:16 am to 8:18 am. These are the two time stamps 16 and 17 in FIG. 10. FIG. 11B relates to a Bin Count for interval length 4 min. FIG. 11C relates to a Bin Count for interval length 10 min, and FIG. 11D relates to a Bin Count for interval length 15 min.

We proceed to the statistical analysis and compute for all possible bin lengths (here from 1 to 719) the mean value, the variance and the standard deviation and apply the Poisson test with threshold s.

Bin-counts that satisfy the threshold s are kept for further analysis, all others are discarded. FIG. 12 displays a table showing bin length, mean value, variance, standard deviation, threshold result and final assessment (accepted/rejected) for bin lengths 1 to 4. (It turns out, all higher bin lengths result in discarded bin-counts). The master bin sample has length 1. From this master bin sample we learn that our game has a purchasing event rate of 0.139 tickets per minute.

In FIG. 12, bins 12,37,206,226,238,272,289,421,455,497, 599 are equally loaded. Bins 12 and 37 are emphasized for illustration. Bin 12 contains the time stamp 11 (i.e. refers to a ticket that was purchased between 8:11 am and 8:12 am). Bin 37 contains the timestamp 36. Referring to our sample data in FIG. 10 we see that timestamp 11 is the second ticket purchase and time stamp 36 is the $6^{th}$ ticket purchase.

Next, we compare the master bin sample to samples generated from a Poisson distribution with mean $\lambda$=0.139. Each Poisson sample is compared with the master bin sample and we pick out all bins which are equally filled with at least one timestamp. FIG. 13 shows the master bin sample and one Poisson generated sample. We keep on generating samples and picking out occupied bins until we have enough timestamps to award the payback tickets.

In our sample of the preferred embodiment the very first Poisson sample already picks out more than enough bins. As indicated in FIG. 13 we have identified the bins 12,37,206,226,238,272,289,421,455,497,599.

We first determine all timestamps in these bins and then randomly pick two of them. The associated two tickets are the payback winners. We make a random permutation to actually award the two payback tickets to these two timestamps (=tickets).That concludes the game.

The invention claimed is:

1. An auction method, which comprises:

providing an object for auction;

defining an amount to be collected from sales of auction tickets to be sold while the auction is open;

opening the auction by offering the auction tickets for sale and thereby uniquely associating each auction ticket with a given identification and, once a given number of auction tickets have been sold, closing the auction;

providing a computer program having program code stored in non-transitory form and being configured, when loaded into a memory of a computer, for determining a winning ticket of the auction and awarding the object to an auction participant holding the winning ticket; and determining one or more payback tickets in accordance with a predefined function related to the given identification associated with a respective said auction ticket;

selling the auction tickets with a variable selling price and determining a winning ticket of the auction by computing a mean entry fee by dividing the total entry fee by the number of tickets sold and deriving therefrom a weight function for weighting a winning chance of each respective ticket, such that: if the entry fee paid for a given ticket equal to, or nearly equal to, the mean entry fee, the chance of winning for the given ticket is an average chance; if the entry fee paid for a given ticket is exceeds the mean entry fee, the chance of winning for the given ticket is an above average chance; if the entry fee paid for a given ticket is less than the mean entry fee, the chance of winning for the given ticket is a below average chance; determining a winner of the object for auction from one of the tickets sold by randomly selecting from a pool of candidates defined by the weight function and determining a winning ticket associated with one auction participant and allowing the one auction participant to take possession of the auction object.

2. The auction method according to claim 1, wherein the step of defining the amount to be collected comprises setting a number of auction tickets to be sold and a uniform selling price for the auction tickets.

3. The auction method according to claim 1, which comprises assigning to each ticket a unique identifier associating the respective ticket with an auction participant, a time stamp representing a time of purchase, and a value stamp representing an amount paid for the ticket.

4. The method according to claim 1, wherein the step of determining one or more payback tickets comprises defining one or more tickets as a payback ticket, which receives back a value at least equal to the mean entry fee, and paying to each auction participant associated with a payback ticket the value at least equal to a mean entry fee.

5. The method according to claim 4, which comprises defining the one or more payback tickets in accordance with a Poisson distribution function.

6. The method according to claim 1, wherein the step of determining one or more payback tickets comprises selecting a ticket with a given time stamp for payback, a given number in an order of purchase of the ticket, a ticket associated with a player having a given number of other associated tickets, or an arbitrary ticket.

* * * * *